US006386540B1

(12) United States Patent
Stevkovski

(10) Patent No.: US 6,386,540 B1
(45) Date of Patent: May 14, 2002

(54) ROTATING SPHERES PUZZLE

(76) Inventor: Saso Stevkovski, 369 Yorkshire Blvd. #209, Dearborn Hts., MI (US) 48127

( * ) Notice: Subject to any disclaimer, the term of this patent is extended or adjusted under 35 U.S.C. 154(b) by 0 days.

(21) Appl. No.: 09/845,614

(22) Filed: Apr. 30, 2001

(51) Int. Cl.[7] ..... A63F 9/08
(52) U.S. Cl. ..... 273/153 S
(58) Field of Search ..... 273/153 R, 153 S, 273/155, 156

(56) References Cited

U.S. PATENT DOCUMENTS 4,415,158 A 11/1983 Engel ..... 273/153 S
4,550,040 A 10/1985 Fisher
4,978,126 A 12/1990 Morosow ..... 273/153 S
5,370,394 A * 12/1994 Huncaga ..... 273/153 S
5,628,512 A * 5/1997 Chan ..... 273/153 S

* cited by examiner

*Primary Examiner*—Steven Wong

(57) ABSTRACT

A rotating spheres puzzle is comprised of plurality of overlapping spherical figures (10), each of which is rotatable about three mutually orthogonal axes with its center as a pivot point, and each of which comprises a base (11) and a plurality of pieces (12) distributed symmetrically on the periphery of the base. The pieces are shareable with neighboring figures and can be moved into corresponding positions in other spherical figures including the overlapping areas by sequentially rotating the figures in predetermined angular increments. The spherical figures are arranged to form a three dimensional matrix of spherical figures, and are surrounded and encased by a housing (14, 15 and 16). The housing has a plurality of openings so as to enable a manual rotation of the spherical figures.

10 Claims, 8 Drawing Sheets

ROTATING SPHERES PUZZLE

CROSS-REFERENCE TO RELATED APPLICATIONS

Not applicable.

STATEMENT REGARDING FEDERALLY SPONSORED RESEARCH AND DEVELOPMENT

Not applicable.

BACKGROUND—Field of Invention

This invention relates generally to a puzzle for entertainment and educational purposes, and in particular to a puzzle which allows the player to rearrange the combination of a plurality of movable pieces.

BACKGROUND—Description of Prior Art

The invention of Engel (U.S. Pat. No. 4,415,158) discloses a puzzle where segmented sections form a geometric figure and each geometric figure has a common segmented section with another geometric figure. Segmented sections rotate about non-orthogonal axes. Prior art also includes puzzles formed by intersecting defined circular members each of which is rotatable about its center and each of which comprises a plurality of discrete pieces formed by intersecting arcs of the members (Fisher at U.S. Pat. No. 4,550,040, and Morosow at U.S. Pat. No. 4,978,126).

SUMMARY OF THE INVENTION

An object of the present invention is to provide a puzzle of intellectual, educational and amusing character.

Another object is to provide a puzzle device that allows an unlimited expansion of the device so as to increase the complication and difficulty in playing the game.

To achieve the above objects, in accordance with the present invention, there is provided a puzzle comprising a plurality of substantially spherical figures, each of the figures having a base and a plurality of pieces on the periphery, the pieces being shareable with neighboring figures. Each spherical figure is rotatable about three orthogonal axes with the center of the figure as a pivot point. The spherical figures are arranged in a three-dimensional matrix, and the matrix is enclosed in a transparent shell. Rotation of the spherical figures about orthogonal axes provides means of rapidly changing the order of the shareable pieces, and increases the variety of combinations.

DRAWING FIGURES

The features and objects of the invention will be better understood from the following detailed description of the typical embodiments illustrated in the accompanying drawings in which.

REFERENCE NUMERALS IN DRAWINGS

Figure 1:
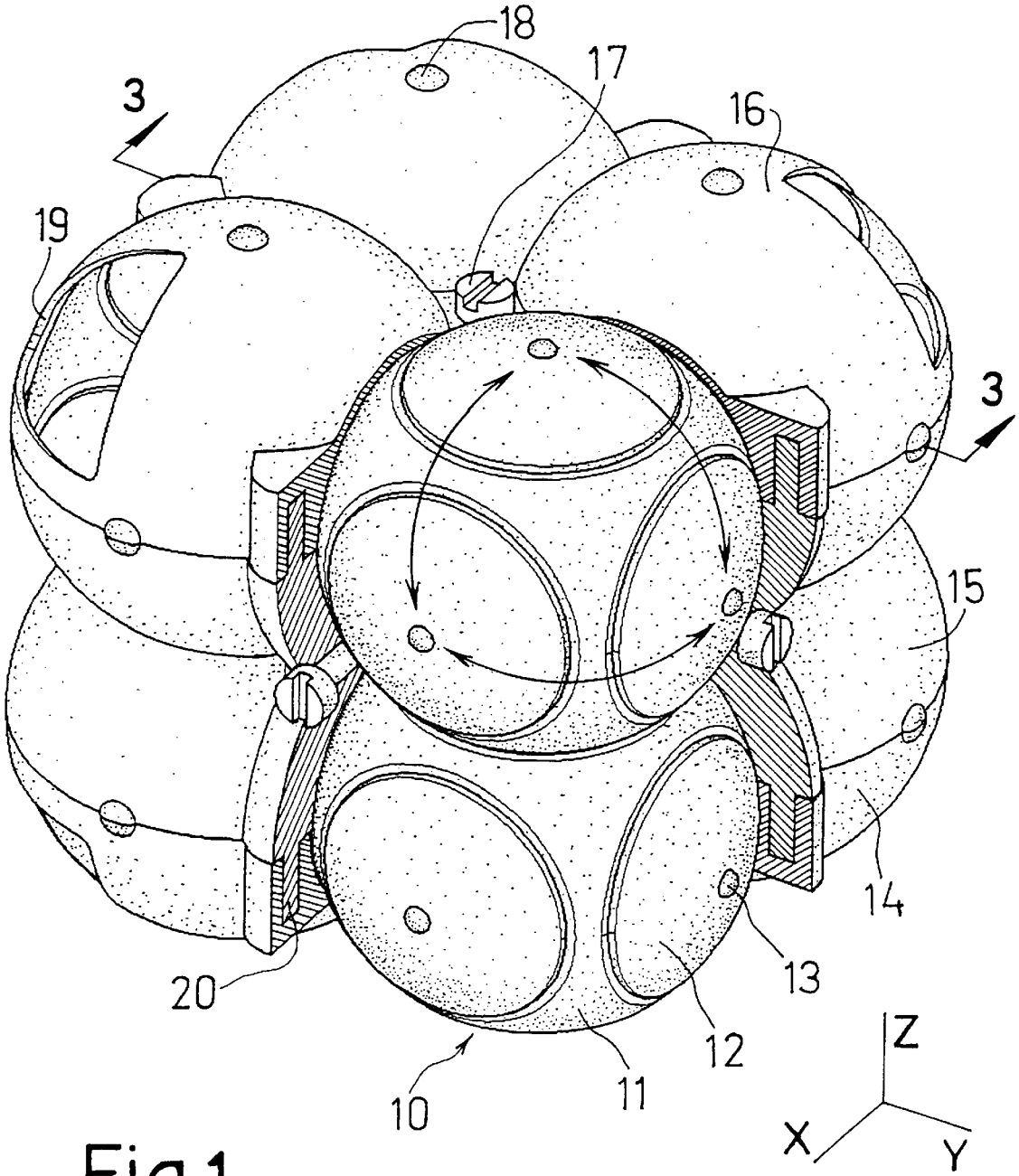
FIG. 1 is an isometric view of the puzzle where housing is shown in a partial sectional view.

10*a,* 10*b,* 10*c* spherical figure
11, 11*a,* 11*b* base
12*a,* 12*b* piece
13 pin
14 bottom housing shell
15 middle housing shell
16 top housing shell
17 bolt
18 dimple
19 opening
20 pole
21 recess
21' dimple
22 spring
23 central support member
24 post
25 hole
26 projection
27 expanded coupling portion
28 base
29 piece
30 piece
31 hole
32 hole
33 raised portion
34 recessed portion
35, 35*a* hole in housing
36 key
37 base
38 piece
39 permanent magnet
40 metal rod
41 base
42 piece
43 cupola
44 channel
45 track
46 leg
47 housing shell

DESCRIPTION OF THE PREFERRED EMBODIMENT

For the purpose of promoting an understanding of the principles of the invention, reference will now be made to the embodiments illustrated in the drawings. Specific language be used to describe the same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
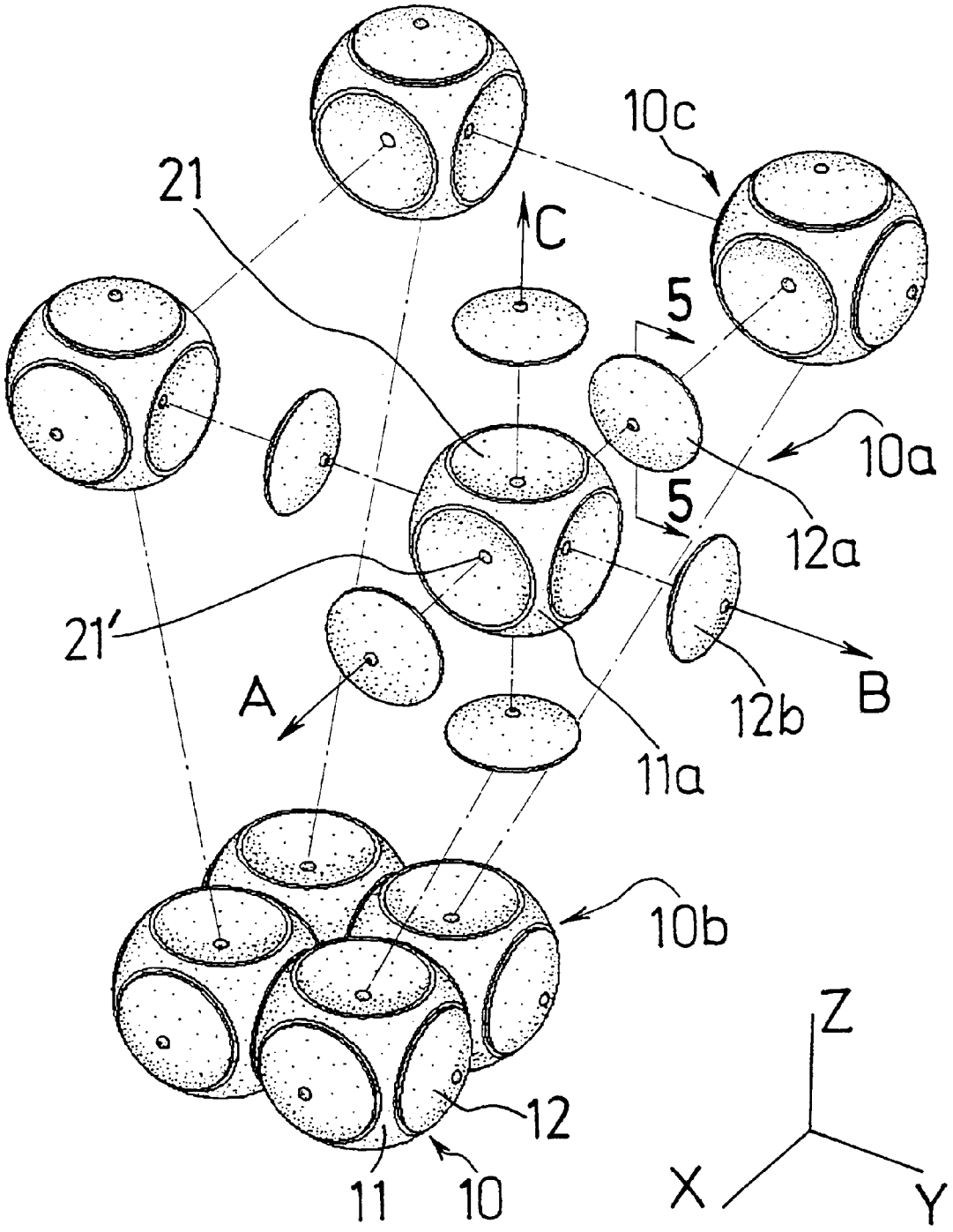
FIG. 2 is an exploded isometric view of the matrix of spherical figures.

Referring to FIGS. 1 through 5, a puzzle in accordance with the present invention is generally comprised of a plurality of substantially spherical FIGS. 10 of same size arranged to form a matrix of spherical figures, and a transparent housing shell (14, 15 and 16) encompassing the matrix of spherical figures. The matrix of the preferred embodiment is of size 2×2×2, having two spherical figures along each of three orthogonal axes (X, Y and Z), or eight spherical figures altogether. A detailed exploded view of the matrix is shown in FIG. 2. Each spherical figure has a local coordinate system associated with it. The origin of the coordinate system is coincident to the center of the respective spherical figure. The axes A, B, and C of the local coordinate system are parallel to the global axes X, Y and Z respectively. The spherical figures are equally spaced between each other, the distance between two neighboring figures being smaller than the diameter of a spherical figure. Consequently, two neighboring spheres intersect each other, the intersecting volume substantially defining an axisymmetric body, or piece 12. Each spherical FIG. 10 comprises a base 11 and six identical pieces 12 as defined above. The pieces are disposed symmetrically on the periphery of the base 11 into respective recesses 21 along the axes A, B, and C. Two neighboring spherical figures disposed in such manner share a common piece. For example, piece 12*a* in FIG. 2 is common to spherical figures 10*a* and 10*c*.

A housing shell made of transparent material surrounds the matrix of spherical figures. The housing shell is comprised of a bottom housing shell 14, a middle housing shell 15, and a top housing shell 16 (shown in an exploded view in FIG. 4). When assembled together, housing shells 14, 15 and 16 form a cavity that corresponds to the exterior boundary of the matrix of spherical figures, thereby maintaining the disposal of spherical figures as specified above. Eight poles 20 protruding from the middle housing shell 15 engage into holes 25 in the bottom and top housing shells. A firm connection is secured by attaching housing shells 14, 15 and 16 to a central support member 23. The central support member comprises six posts 24 protruding from the center towards the six sides of the housing. The posts 24 are attached to six projections 26 protruding from the sides of the housing towards the center, via bolts 17.

Within the housing, every spherical figure is free to rotate independently about its center. If a spherical figure is rotated for 90 degrees about one of the three orthogonal axes A, B and C, the appearance of the puzzle changes. A previously hidden piece becomes visible to the player, and a previously visible piece becomes hidden (or common to two figures). For example, if spherical FIG. 10*a* in FIG. 2 is rotated about the C-axis, the new position of piece 12*a* could be the position previously occupied by piece 12*b*. With this rotation, previously shared disc 12*a* becomes an exterior boundary of the matrix, and is visible to the player.

Figure 3:
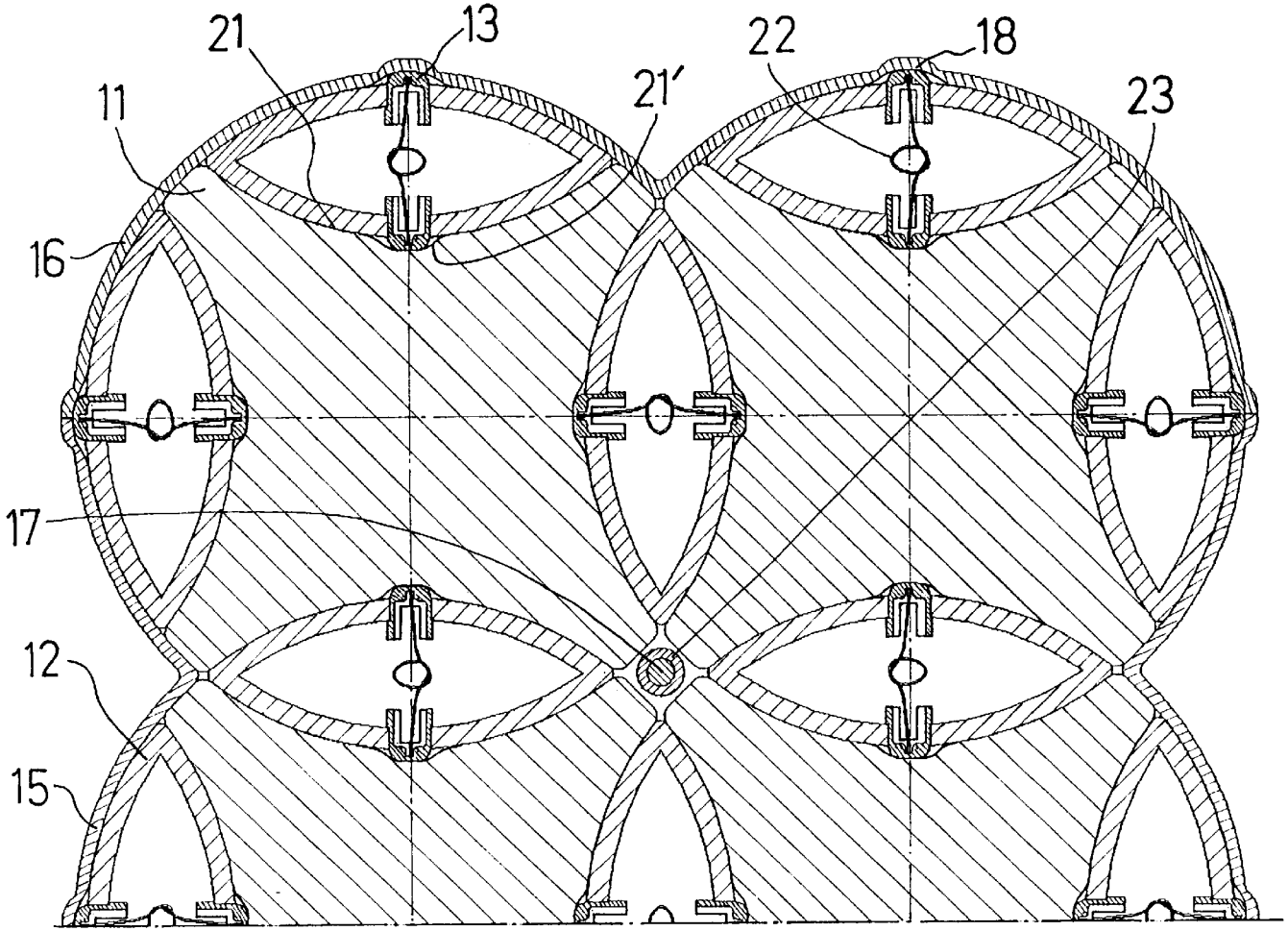
FIG. 3 is a cross sectional view marked 3—3 in FIG. 1.
Figure 4:
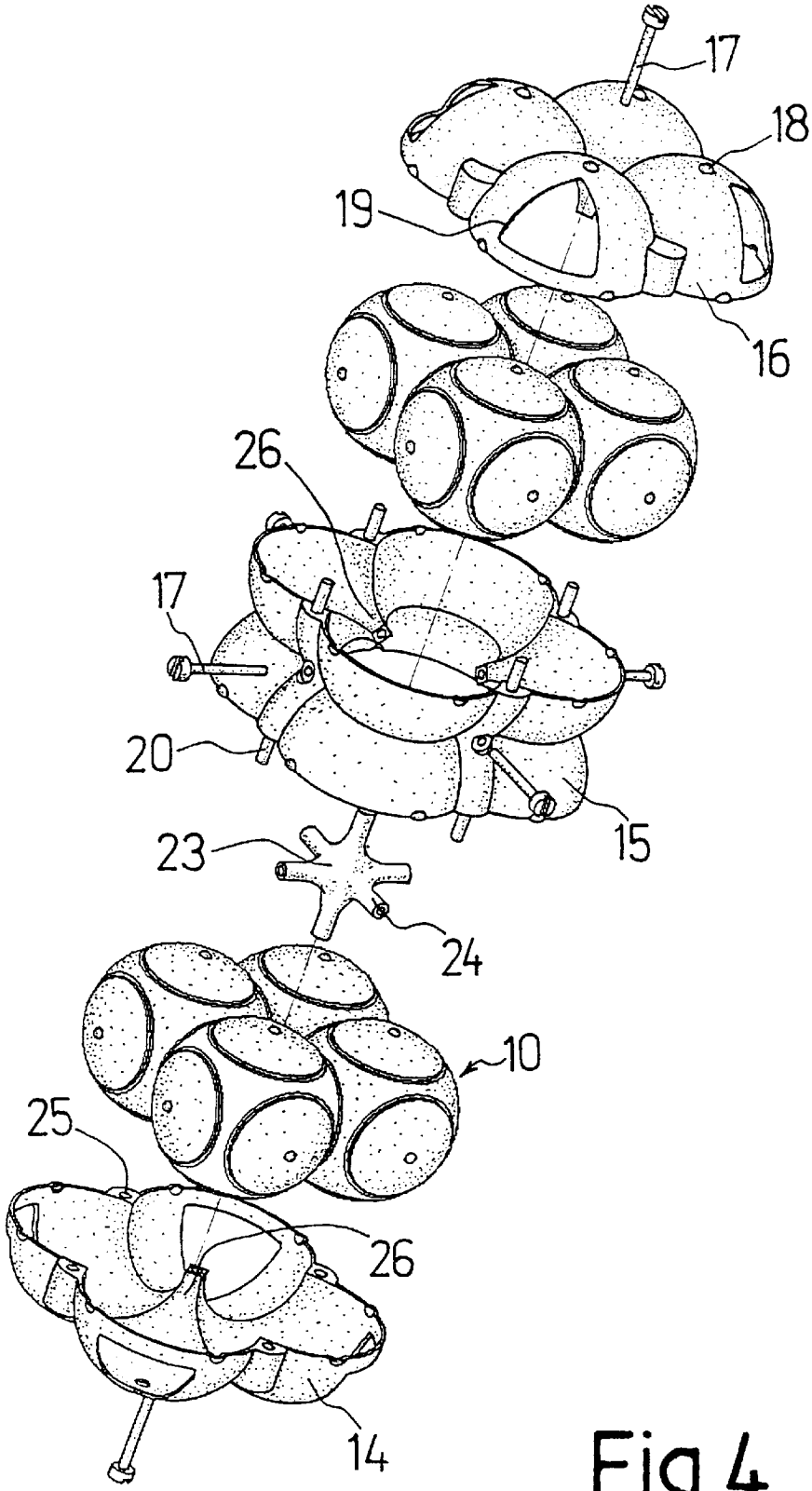
FIG. 4 is an exploded isometric view of the puzzle.
Figure 5:
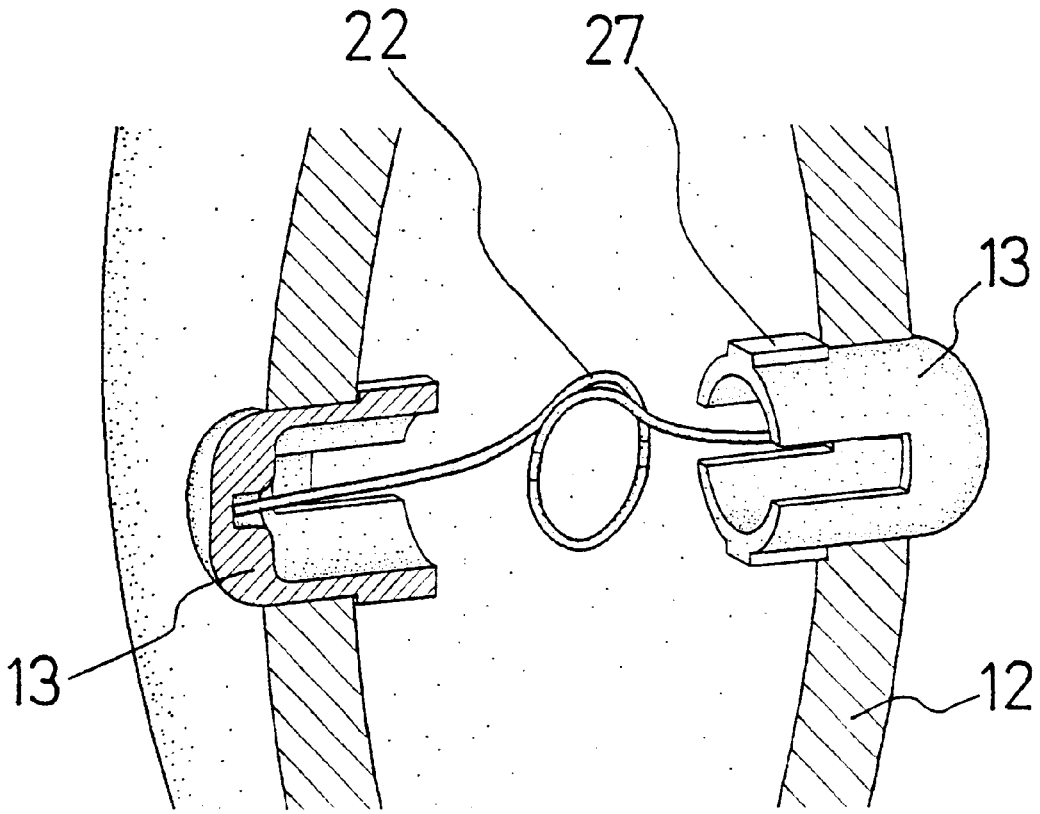
FIG. 5 is a cross-sectional view marked 5—5 in FIG. 2.

To guide the spherical figures to rotate about the axes A, B, and C in 90-degree angular increments, split pins 13 are used. As shown in FIG. 5, two split pins 13 are inserted into piece 12. Once the pins are inserted, a spring 22 exerts force and keeps the expanded coupling portions 27 in contact against the interior wall of piece 12. Rounded end-portions of the pins engage into corresponding dimples 18 in the housing shell, as well as into corresponding dimples 21' at the center of recesses 21 of base 11, as seen in FIG. 3. The player rotates the spherical figures through openings 19 in the transparent shell, by applying rotational force along the periphery of the rotating spherical figure. The boundary pins of the rotating spherical figure that lie along the direction of rotation disengage the respective housing dimples 18 and base dimples 21' as they get pressed towards the center of the figure. After a 90-degree rotation, the pins engage again into corresponding dimples. The boundary pins along the axis of rotation remain engaged and help preserving the direction of rotation.

Indicia of different kinds can be printed on the exterior surfaces of the pieces, as well as on the visible portions of the base. In one particular game, the exterior surfaces of the pieces are colored differently and pieces are scrambled, and the player has to return them to an original position. The present embodiment includes thirty-six pieces altogether, of which, twenty-four are exterior at any time, and twelve are hidden (common to two figures). Considering that every piece has two exterior surfaces of which just one may be visible, there are seventy-two surfaces potentially visible, just twenty-four of which are visible at a time. This shows the potential for a variety of games with different levels of complexity that can be played.

Alternative Embodiments

Figure 6:
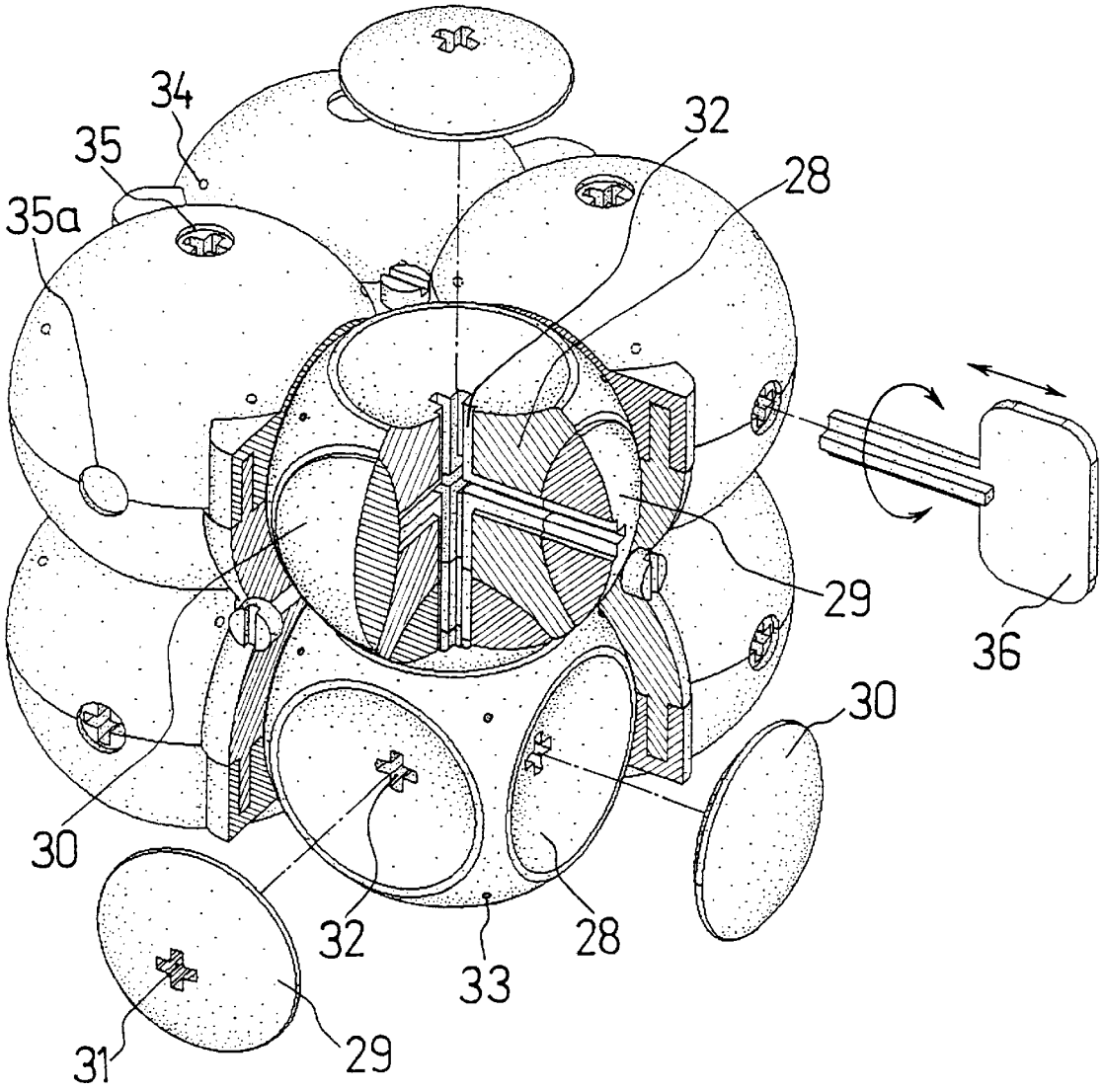
FIG. 6 is an isometric partial sectional view of an alternative embodiment of the puzzle.

FIG. 6 shows an embodiment of the present invention where key 36 is utilized for rotation of spherical figures. The key is inserted through holes 35 in the transparent housing shell along the axes A, B and C. The extruded portion of the key 36 has a predetermined cross-sectional shape matching the cross-sectional shape of holes 31 into piece 29, and the cross section of holes 32 into base 28. Holes 31 and 32 are made along the axes A, B and C. Raised portions 33 symmetrically spaced on the periphery of the base 28 alternatively engage respective recessed portions 34 on the transparent shell. Therefore the spherical figure can be rotated independently relative to the transparent shell and alternatively positioned at 90-degree increments by inserting and turning key 36. To increase the complexity of the game, some of the pieces may be deprived from holes (such as disc 30 in FIG. 6), and the player cannot insert key 36 through such pieces. For example, the player can make a rotation through the hole 35, but cannot rotate the same figure through the hole 35*a* since there is no opening in the corresponding piece. In one particular game, the discs without holes are the ones to be made invisible (common to two figures).

Figure 7:
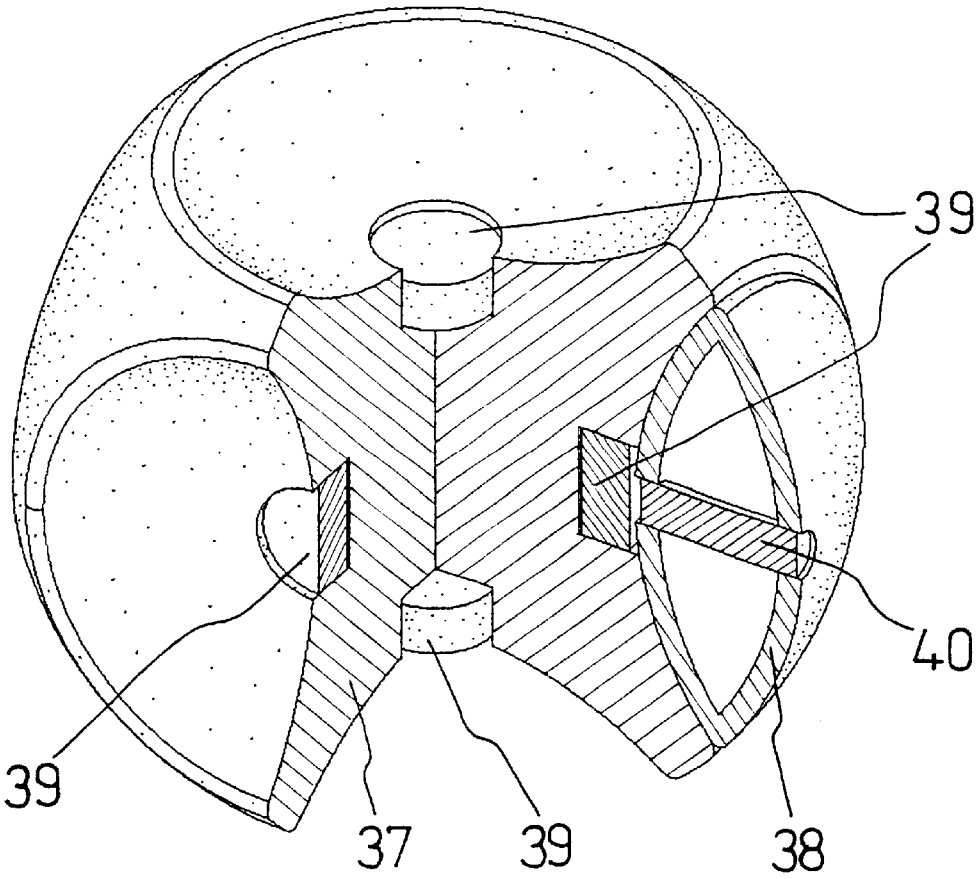
FIG. 7 is an isometric partial sectional view of an alternative spherical figure embodiment.

Alternative means of guiding spherical figures to rotate about the axes A, B, and C in 90-degree angular increments are shown in FIG. 7. Permanent magnets are utilized to keep the figures in proper position after every 90-degree rotation. Six permanent magnets 39 are embedded at the bottom of the recesses of each base 37. Metal rod 40 is placed into each piece 38 along the orthogonal axes A, B and C. Of six discs on the periphery of a spherical figure, three are common to other figures at any time. Metal rods 40 that belong to the three common pieces, are sandwiched between two permanent magnets belonging to two neighboring bases, and will tend to preserve such position after every 90-degree rotation.

Figure 9:
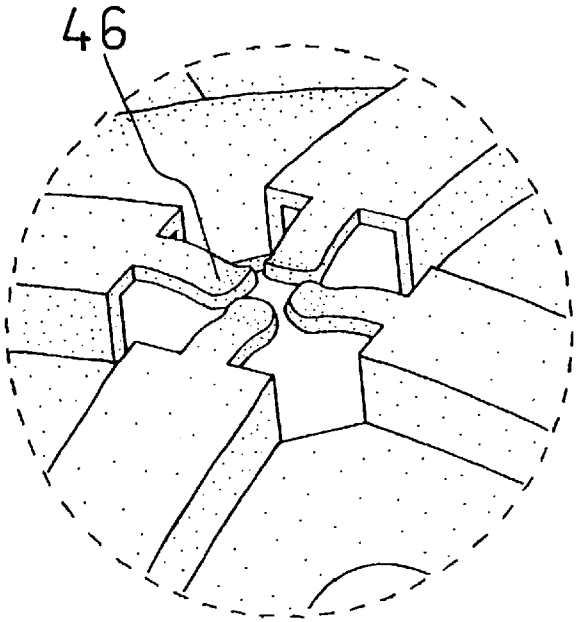
FIG. 9 is an isometric view of the detail marked 9 in FIG. 8.
Figure 8:
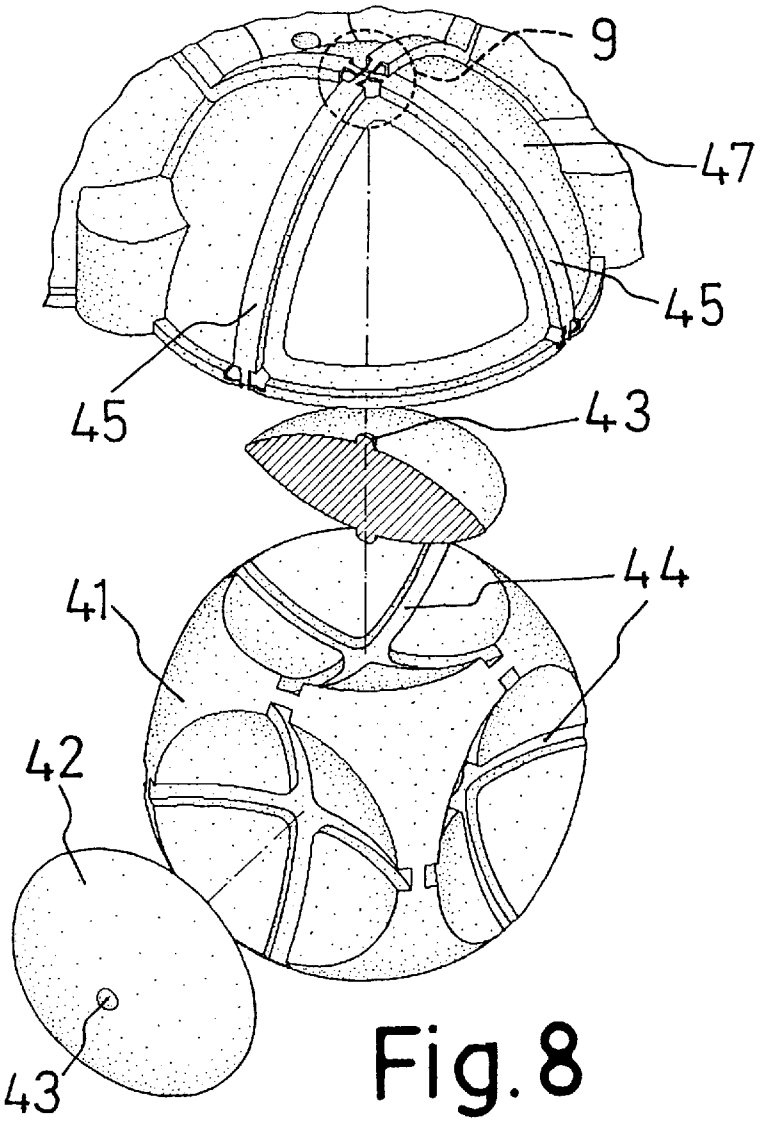
FIG. 8 is an isometric partial sectional view of an alternative embodiment of the puzzle.

Yet another alternative means of guiding spherical figures to rotate about the axes A, B, and C in 90-degree angular increments are shown in FIGS. 8 and 9. Base 41 has recesses with circumferential channels 44 intersecting each other at right angles at the centers of the respective recesses. Pieces 42 have cupolas 43 at the centers of both sides. Housing 47 has circumferential tracks 45 in planes that are normal to the axes A, B and C and pass through centers of the spherical figures. In areas where tracks 45 intersect each other there are four bended legs 46 protruding towards the center of the intersection. The cupolas on the periphery of a rotating spherical figure travel along channels 44 and tracks 45. After every 90-degree rotation about one of the axes A, B, and C, the peripheral cupolas are locked into position by the legs 46.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A puzzle comprising (a) a plurality of substantially spherical figures of same size arranged to form a three-dimensional matrix of spherical figures along three orthogonal axes X, Y, and Z, said spherical figures equally spaced between each other and overlapping to form areas of common intersection;

(b) each of said spherical figures further comprising a base and a plurality of pieces on the periphery of said base, said base having a plurality of recesses on the periphery, said recesses symmetrically disposed around the center of said base, said pieces disposed into said recesses respectively, whereby said pieces within said areas of common intersection are common to two neighboring spherical figures;

(c) each of said spherical figures having three orthogonal axes A, B, and C associated thereto, said axes A, B and C being parallel to said orthogonal axes X, Y and Z respectively and passing through the center of the respective one of said spherical figures, each of said spherical figures being rotatable about said orthogonal axes A, B and C, whereby said pieces can be moved into corresponding recesses in other spherical figures including said areas of common intersection by sequentially rotating said spherical figures in predetermined angular increments;

(d) a housing surrounding and encasing said matrix of spherical figures, said housing having walls that substantially limit any translation of said spherical figures, said walls enabling rotation of each of said spherical figures about said orthogonal axes A,B and C;

(e) means of guiding said spherical figures to rotate one at a time in predetermined angular increments about said orthogonal axes A, B and C.

2. The puzzle of claim 1 wherein there are defined six of said recesses on the periphery of said base, surfaces of said recesses substantially being concave portions of spheres, the size and the spacing of said spheres relative to said base being substantially equivalent to the size and the spacing of said spherical figures.

3. The puzzle of claim 1 wherein the exterior shape of each of said pieces is substantially defined by the intersection of two overlapping spheres, the size and the spacing of said spheres being substantially equivalent to the size and the spacing of two of said spherical figures.

4. The housing of claim 1 made of a transparent material and having a plurality of openings, wherein said spherical figures can be rotated manually through said openings.

5. The housing of claim 1 further comprising a bottom housing shell, a middle housing shell, a top housing shell, and a central support member having six posts symmetrically positioned around the center thereof, said bottom and top housing shells being identical to each other, said three housing shells forming a cavity substantially identical to the exterior shape of said matrix of spherical figures, said matrix of spherical figures comprising eight spherical figures, centers of the lower four of said spherical figures defining a plane that divides said bottom and middle housing shells, centers of the upper four of said spherical figures defining a plane that divides said middle and top housing shells, said housing having six projections extruding from each of the six sides of said housing towards the center thereof, each of said projections having means of attaching to a corresponding one of said posts.

6. The puzzle of claim 1 wherein said guiding means comprise two pins slidably attached into each of said pieces along said orthogonal axes A, B and C, said pins being not fully inserted into said pieces, wherein rounded end-portions of said pins protrude outside the exterior surfaces of said pieces, said rounded end-portions engaging respective dimples in said housing and in said bases, whereby said rounded end-portions that are on the periphery of a respective rotating spherical figure are urged to disengage said dimples during the rotation of said rotating spherical figure by sliding towards the center thereof, wherein a spring element pushes said rounded end-portions into a new set of said dimples after every incremental rotation.

7. The puzzle of claim 1 wherein said guiding means comprise a plurality of raised portions on the exterior surfaces of said base other than the surfaces of said recesses, said raised portions distributed symmetrically around the center of said base and alternatively engaging respective recesses portions on said walls of said housing.

8. The puzzle of claim 1 wherein said guiding means comprise a plurality of permanent magnets embedded at the bottom of said recesses of said base, and plurality of metal rods inserted into said pieces along said orthogonal axes A, B and C.

9. The puzzle of claim 1 wherein said guiding means comprise a plurality of cupolas on said pieces, said cupolas distributed one on each side of said pieces at the center thereof, a plurality of circumferential channels along said recesses of said bases, said channels intersecting each other at right angles, a plurality of circumferential tracks around said housing, said tracks intersecting each other at right angles, a plurality of legs in areas where said tracks intersect each other, said legs protruding towards the center of the intersection, whereby said cupolas travel along said channels and said tracks and are being locked between said legs after every incremental rotation of respective one of said spherical figures.

10. The puzzle of claim 1 further comprising (a) a key having an extruded portion with a predetermined cross-sectional shape;

(b) a plurality of holes through the walls of said housing, said holes extruded along said orthogonal axes A, B, and C;

(c) a plurality of holes through each of said bases, said holes extruded along said orthogonal axes A, B, and C, said holes having a predetermined cross-sectional shape;

(d) a hole through at least three of said pieces, said hole extruded along respective one of said orthogonal axes A, B, and C, said hole having a predetermined cross-sectional shape, whereby said extruded portion of said key can be inserted into said puzzle along respective one of said orthogonal axes A, B, and C, wherein said spherical figures can be rotated by turning said key.

* * * * *